US012331741B2

(12) United States Patent
Le Duc et al.

(10) Patent No.: US 12,331,741 B2
(45) Date of Patent: Jun. 17, 2025

(54) VANE PUMP ROTORS

(71) Applicant: Hamilton Sundstrand Corporation, Charlotte, NC (US)

(72) Inventors: Zachary Allen Ray Le Duc, Rockford, IL (US); Edward W. Goy, Crystal Lake, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 18/204,262

(22) Filed: May 31, 2023

(65) Prior Publication Data

US 2024/0401591 A1 Dec. 5, 2024

(51) Int. Cl.
*F04C 2/344* (2006.01)
*F04C 15/00* (2006.01)

(52) U.S. Cl.
CPC ..... *F04C 15/0088* (2013.01); *F04C 2/344* (2013.01); *F04C 2/3441* (2013.01); *F04C 15/003* (2013.01); *F04C 2240/20* (2013.01)

(58) Field of Classification Search
CPC .. F04C 15/0088; F04C 2/344; F04C 2240/20; F04C 2/3441; F04C 2/3446; F04C 15/0023; F04C 15/003; F04C 15/06; F01C 21/104; F01C 21/108
See application file for complete search history.

(56) References Cited

U.S. PATENT DOCUMENTS

| | | | | |
|---|---|---|---|---|
| 999,753 | A * | 8/1911 | Curtis | F04C 2/3446 418/269 |
| 3,320,897 | A * | 5/1967 | Eickmann | F04C 2/3441 418/268 |
| 10,030,655 | B2 | 7/2018 | Terada | |
| 2017/0184100 | A1* | 6/2017 | Nishikawa | F04C 2/344 |

FOREIGN PATENT DOCUMENTS

| | | | |
|---|---|---|---|
| DE | 3014519 | A1 | 10/1981 |
| DE | 102010028061 | A1 | 10/2011 |
| EP | 2151542 | A2 | 2/2010 |
| RU | 2209344 | C1 | 7/2003 |

OTHER PUBLICATIONS

WO2005003564A1—Aota et al.—Vane Pomp or Supplying Pressurized Oil to Power Sterring Device, has an outer surface of Main and Sub Portions of slot Formation of Rotor, Formed in Convex Show with Same Height as Side Faces of Rotor. (Year: 2005).*
Extended European Search Report dated Oct. 22, 2024, for corresponding European Patent Application No. 24178941.1, 11 pgs.

* cited by examiner

*Primary Examiner* — Theresa Trieu
(74) *Attorney, Agent, or Firm* — Kinney & Lange, P.A.

(57) ABSTRACT

In accordance with at least one aspect of this disclosure, a system includes a rotor configured to rotate about a rotor axis within a pump housing. In embodiments, the rotor includes, a first end face configured to interface with a stationary port plate, a plurality of vane slots defined in the rotor arranged circumferentially about the rotor axis configured to accept a respective vane therein, and a plurality of (Continued)

lands between each vane slot, wherein each land includes a portion of the first end face. The rotor also includes, a lubrication pad defined in the first end face of at least one land between neighboring vane slots such that the lubrication pad is fed by the neighboring vane slots to induce buildup of a lubrication film between the first end face and the stationary port plate in the lubrication pad.

14 Claims, 3 Drawing Sheets

Fig. 5
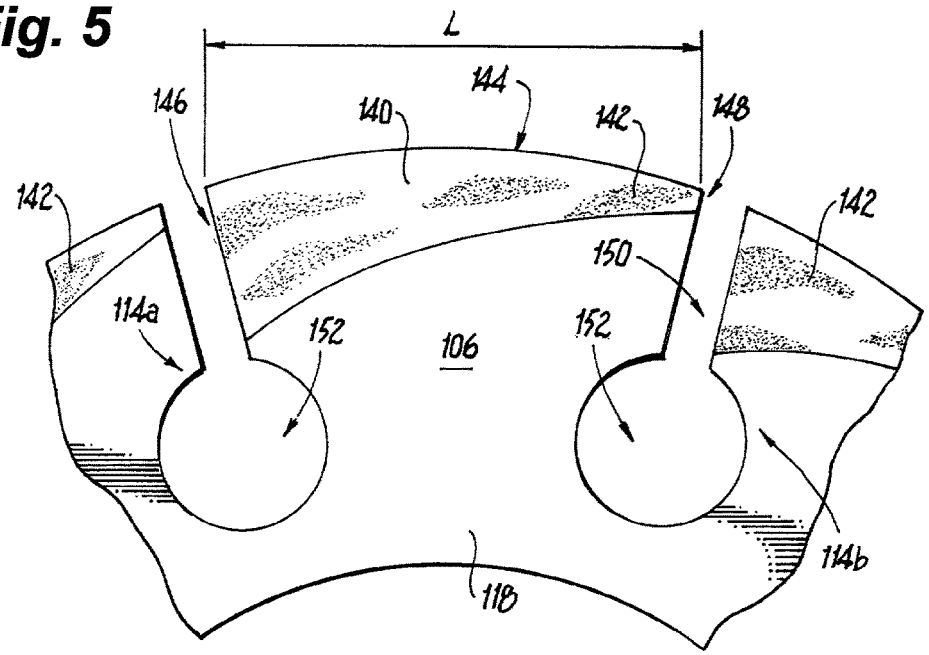
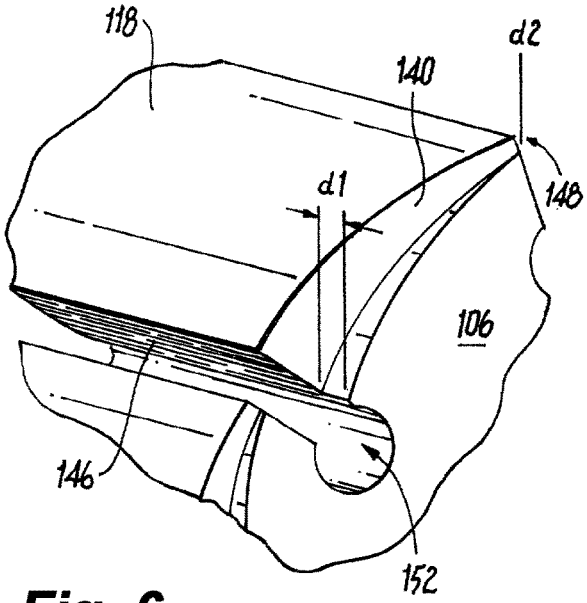
Fig. 6
Fig. 7
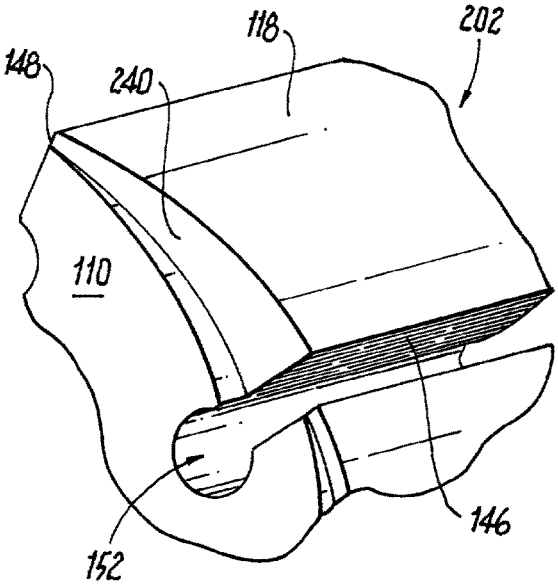

VANE PUMP ROTORS

TECHNICAL FIELD

The present disclosure relates to rotors and more particularly to rotors for vane pumps.

BACKGROUND

Current vane pumps use a rotor to rotate vanes along a liner to displace fluid in a pumping action. The rotor is situated between a fixed, or stationary port plate, and either a pressure-loaded port plate, or another fixed port plate. In the arrangement of two fixed port plates, the pump is referred to as a fixed clearance pump. In both cases, the design of the pump factors in pressure-velocity (PV) at the rotor-port plate interfaces to determine wear characteristics and select materials. High values of PV at the PV interface can reduce materials available for selection and can lead to more expensive materials, heat treatments, and/or coatings, or can lead to the selection of naturally more wear resistance materials that can have negative weight or fracture toughness implications for the product.

The conventional techniques have been considered satisfactory for their intended purpose. However, there is an ever present need for improved rotors that allow for a wider range of materials to be used for the rotor. This disclosure provides a solution for this need.

SUMMARY

In accordance with at least one aspect of this disclosure, a system includes a rotor configured to rotate about a rotor axis within a pump housing. In embodiments, the rotor includes, a first end face configured to interface with a stationary port plate, a plurality of vane slots defined in the rotor arranged circumferentially about the rotor axis configured to accept a respective vane therein, and a plurality of lands between each vane slot, wherein each land includes a portion of the first end face. The rotor also includes, a lubrication pad defined in the first end face of at least one land between neighboring vane slots such that the lubrication pad is fed by the neighboring vane slots to induce buildup of a lubrication film between the first end face and the stationary port plate in the lubrication pad.

A central bore can be defined through the rotor configured to receive a shaft therein, the shaft configured to drive rotation of the rotor about the rotational axis. In certain embodiments, the rotor can include one or more portions of a shaft operatively connected thereto. In embodiments, a plurality of vanes can be included such that each vane is disposed in a respective vane slot configured to drive the fluid with rotation of the rotor in the pump housing. In embodiments, the stationary port plate can be disposed on the shaft proximate the first end face. One or more bearings can be disposed on the shaft, such as journal bearings, and a bearing retainer can be included on the shaft configured to retain the bearings.

In certain embodiments, the pump housing can be or include a cam housing, and the system can include a cam liner. The rotor can be inserted into the cam liner to rotate within the cam liner when the pump is operating. A first end cap can be disposed on the on the shaft board of the stationary port plate configured to axially retain the components on the shaft. In embodiments, the stationary port plate can include a first fluid port configure to fluidly communicate an inlet pressure with the vane slots of the rotor and open space in the cam liner. During the pumping action, e.g., rotation of the rotor, the vanes can be configured to draw the inlet pressure from the first fluid port into the vane slots and the cam liner. In embodiments, the stationary port plate can include one or more second ports configured to fluidly communicate a discharge pressure with an outlet of the pump such that fluid within the cam liner and vane slots are pumped to the outlet of the pump.

In embodiments, the lubrication pad can be machined into the first end face, for example as an indentation or a divot in the first end face. In embodiments, the lubrication pad can be defined in an outer periphery of the first end face. In certain embodiments, the lubrication pad can be defined in the first end face at a radially outer portion of the first end face.

In embodiments, the lubrication pad can include a polygonal shape defined between a leading edge and a trailing edge of the at least one land relative to the direction of rotation of the rotor. In certain embodiments, the length of the polygonal shape can extend along a portion the first end face between leading edge and the trailing edge. In certain embodiments, the length of the polygonal shape can extend along an entirety of the first end face between leading edge and the trailing edge.

In embodiments, a leading edge depth of the lubrication pad can be deeper at or near the leading edge of the land and gradually shallows in a circumferential direction (e.g., in a direction of flow over the lubrication pad) to a trailing edge depth. The trailing edge depth can be shallower at or near the trailing edge of the land than at the leading edge of the land.

In embodiments, each vane slot can include a straight portion and a round portion radially inward of the straight portion. The round portion can be configured to hold fluid fluid during rotation of the rotor. At least a portion of the leading edge depth of the lubrication pad can be defined in the first end face proximate the straight portion of a leading edge neighboring vane slot to draw fluid from the straight portion of the vane slot.

In certain embodiments, a number of lubrication pads can be equal to a number of lands of the rotor, wherein each land includes one lubrication pad.

In certain embodiments, a number of lubrication pads can be double a number of lands of the rotor, wherein each land includes two lubrication pads, one on the first end face and one on a second end face. The second end face can be the same or similar to the first end face, in embodiments. In certain embodiments, the polygonal shape of the lubrication pad defined in the second end face can be different than the polygonal shape of the lubrication pad defined in the first end face.

The second end face is opposite the first end face along the rotor axis. Each land can additionally include a portion of the second end face and a lubrication pad can be defined in the second end face of at least one land between neighboring vane slots such that the neighboring vane slots feed a fluid to the lubrication pad to create a lubrication film between the second end face and a second stationary port plate. The second stationary port plate can be disposed on the shaft proximate the second end face opposite the first end face.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, other embodiments thereof will be described in detail herein below with reference to certain figures, wherein:

FIG. 5 is a partial front end elevation view of the rotor of FIG. 3;

FIG. 6 is an enlarged partial perspective view of a land of the rotor of FIG. 3; and FIG. 7 is an enlarged partial perspective view of a reverse side of a land of the rotor of FIG. 3.

DETAILED DESCRIPTION

Figure 1:
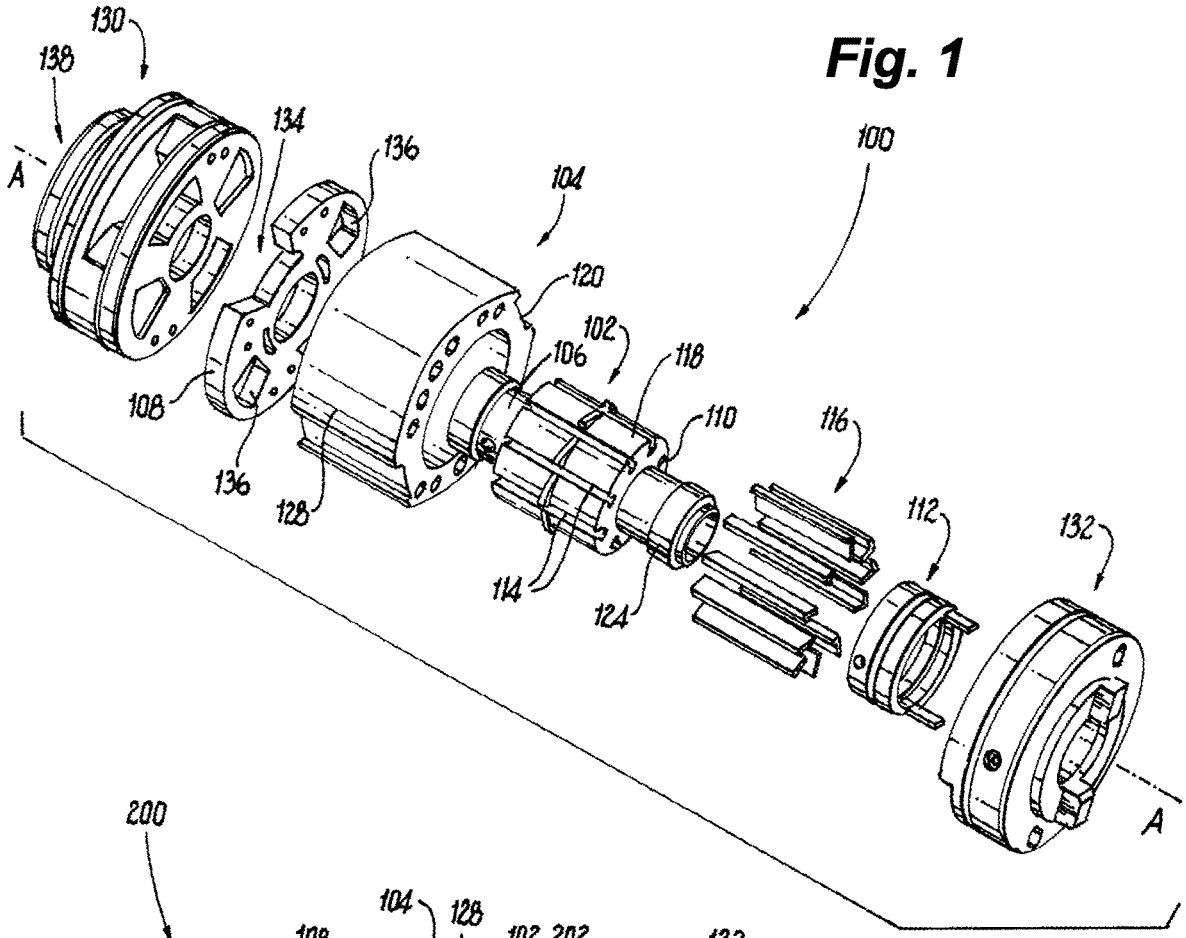
FIG. 1 is an exploded perspective view in accordance with this disclosure, showing an embodiment of a system having, among other things, a rotor.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 1 and is designated generally by reference character 100. Other embodiments and/or aspects of this disclosure are shown in FIGS. 2-7.

Figure 2:
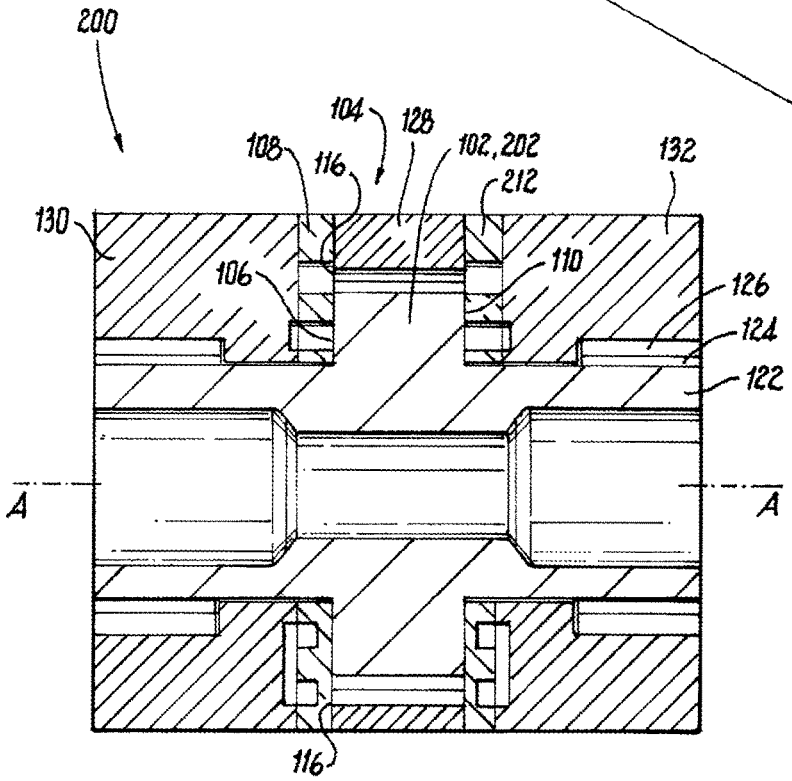
FIG. 2 is an axial cross-sectional view of another embodiment of a system having, among other things, a rotor.

In accordance with at least one aspect of this disclosure, a system 100 can include a rotor 102 configured to rotate about a rotor axis A within a pump housing 104. In embodiments, the rotor 102 includes, a first end face 106 configured to interface with a first stationary port plate 108 and a second end face 110 opposite the first end face 106 along the rotor axis A configured to be adjacent a second port plate 112. As shown in FIG. 1, the first port plate 108 can be a stationary or fixed port plate, and the second port plate can be a pressure loaded port plate 112. In certain embodiments, as shown in FIG. 2, the system 200 can include a first stationary port plate 108 and the second port plate 212 can be also be a stationary port plate. A plurality of vane slots 114 are defined in the rotor 102 arranged circumferentially about the rotor axis A configured to accept a respective vane 116 therein and a plurality of lands 118 are defined between each vane slot 114. As shown, each land 118 includes a portion of the first end face 106.

Figure 3:
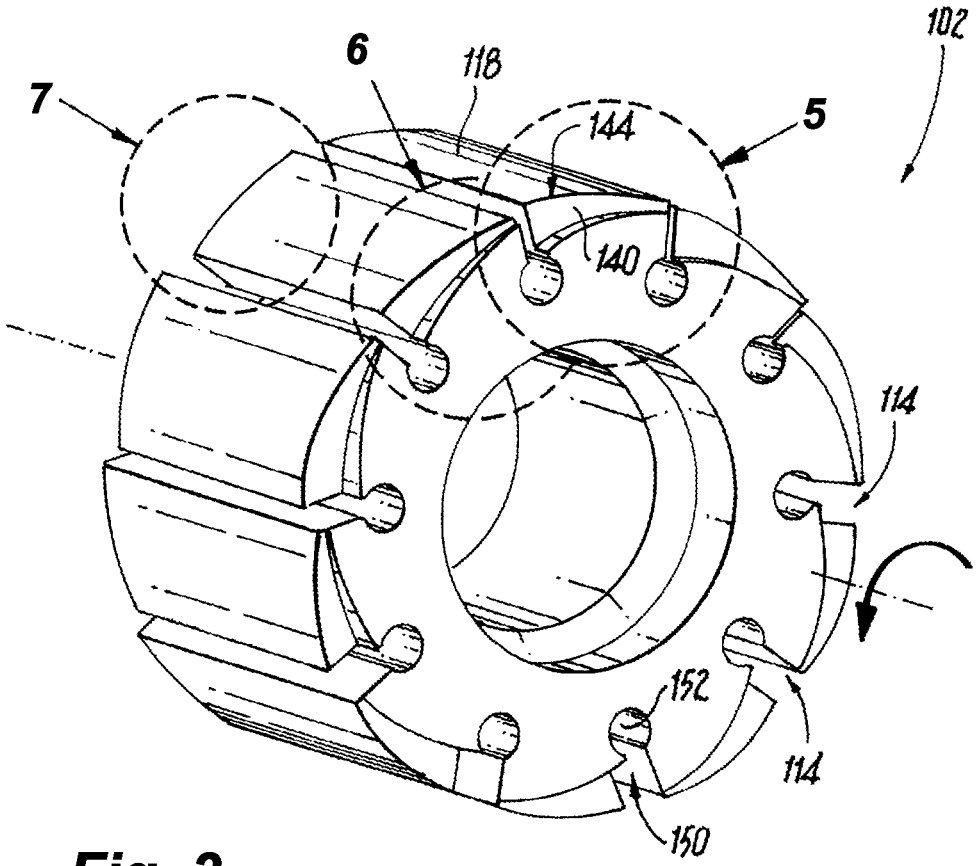
FIG. 3 is a perspective view of an embodiment of a rotor configured for use in the system of FIG. 1.
Figure 4:
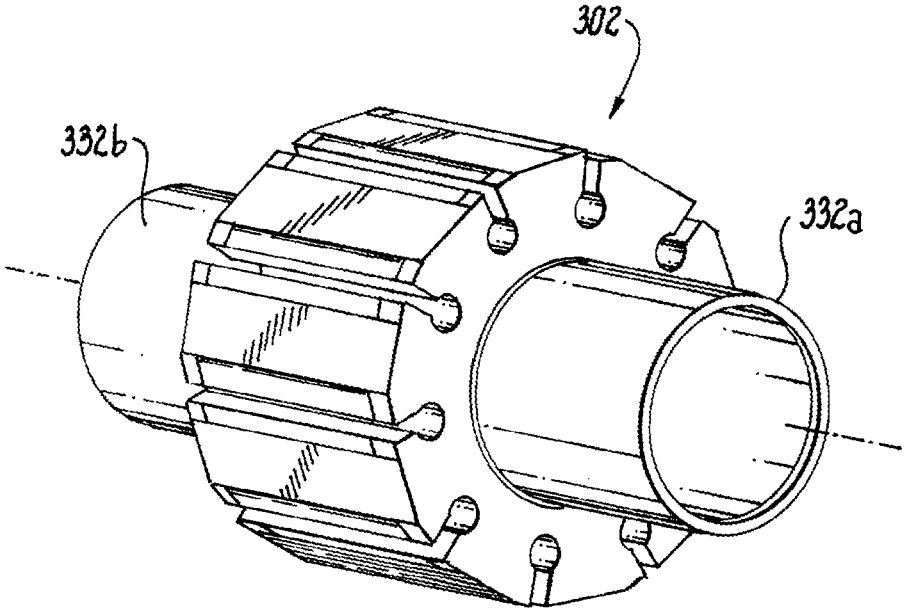
FIG. 4 is a perspective view of another embodiment of a rotor configured for use in the system of FIG. 1.

As shown in FIGS. 1-3, a central bore 120 can be defined through the rotor 102 configured to receive a shaft 122 therein, the shaft 122 configured to drive rotation of the rotor 102 about the rotational axis A. In certain embodiments such as shown in FIG. 4, the rotor 302 can include one or more portions of a shaft 322*a*, 322*b* operatively connected thereto. In embodiments, the plurality of vanes 116 can be included such that each vane 116 is disposed in a respective vane slot 114 configured to drive the fluid with rotation of the rotor 102 in the pump housing 104. In embodiments, the first stationary port plate 108 can be disposed on the shaft 122 proximate the first end face 106 and the second port plate 112 can be disposed on the shaft 122 proximate the second end face 110. One or more bearings 124 can be included to facilitate rotation of the shaft 122, such as journal bearings, and a bearing retainer 126 can be included radially outboard of the bearings 124 configured to retain the bearings 124 within the system.

In certain embodiments, the pump housing 104 can be or include a cam housing and can include a cam liner 128. The rotor 102 can be inserted into the cam liner 128 to rotate within the cam liner 128 when the pump 100 is operating. A first end cap 130 can be disposed on the on the shaft 122 outward of the first stationary port plate 108 and a second end cap 132 can be disposed on the shaft 122 outward of the second port plate 112, each end cap 130, 132 configured to axially retain the components on the shaft 122. The one or more bearings 124 can be retained within the retainers 126, wherein the retainers are fitted within the respective end caps 130, 132.

In embodiments, the first stationary port plate 108 can include a first fluid port 134 configure to fluidly communicate an inlet pressure with the vane slots 114 of the rotor 102 and open space in the cam liner 128 between the liner and the rotor 102 and vanes 116. During the pumping action, e.g., rotation of the rotor 102, the vanes 116 can be configured to draw the inlet pressure from the first fluid port 134 into the vane slots 114 and the cam liner 128. In embodiments, the first stationary port plate 108 can include one or more second ports 136 configured to fluidly communicate a discharge pressure with an outlet 138 of the pump 100 (e.g., defined through end cap 130 in FIG. 1) such that fluid within the cam liner 128 and vane slots 114 is pumped to the outlet 138 of the pump 100. In certain embodiments, the ports 136 can be defined in both end caps configured to communicate the discharge pressure through an outlet 138 in both the first end cap 130 and the second end cap 132.

With reference now to FIGS. 5-6, the rotor 100 can include a lubrication pad 140 defined in at least the first end face 106 of at least one land 118 between neighboring vane slots 114*a*, 114*b*. The lubrication pad 140 can be positioned on the first end face 106 of the land 118 such that the lubrication pad 140 is fed by the neighboring vane slot 114*a*. The positioning of the lubrication pad 140, and its features (e.g., shape and depth) can be configured to induce a buildup of a lubrication film 142 in the lubrication pad 140 between the first end face 106 and the first stationary port plate 108. This is discussed further below.

In embodiments, the lubrication pad 140 can be machined into the first end face 106, for example as an indentation or a divot in the first end face 106. In embodiments, the lubrication pad 140 can be defined in an outer periphery 144 of the first end face 106, for example, the lubrication pad 140 can be defined in the first end face 106 at a radially outer portion of the first end face 106, e.g., a radially outer half of the land 118.

In embodiments, the lubrication pad 140 can include a polygonal shape defined between a leading edge 146 and a trailing edge 148 of the at least one land 118 relative to the direction of rotation of the rotor 102. In certain embodiments, the length l of the polygonal shape can extend along an entirety of the circumferential length of the first end face 106 between the leading edge 146 and the trailing edge 148 of the land 118, e.g., as shown in FIG. 5. In certain embodiments, such as shown in FIG. 5, the length l of the polygonal shape can extend along only a portion of the axial length of the first end face 106 between leading edge 146 and the trailing edge 148 of the land 118. The size and location of the lubrication pad 140 can be application specific, for example based on pressure load. As an example, the schematic lubrication pad 140 shown in FIG. 5 can represent an outer boundary of the lubrication pad 140, and the pad can be defined anywhere within the outer boundary based on application.

In embodiments, a leading edge depth d1 of the lubrication pad 140 relative to the plane of the land can be deeper at or near the leading edge 146 of the land 118 and gradually shallows in a circumferential direction (e.g., in a direction of flow over the lubrication pad 140) to a trailing edge depth d2. The trailing edge depth d2 can be shallower at or near the trailing edge 148 of the land 118 than the leading edge depth d1, e.g., as shown in FIG. 6.

Still with reference to FIGS. 5 and 6, in embodiments, each vane slot 114 can include a straight portion 150 and a round portion 152 radially inward of the straight portion 150. The round portion 152 can be configured to hold fluid during rotation of the rotor 102 (e.g., while pumping). At least a portion of the leading edge depth d1 of the lubrication pad 140 can be proximate the straight portion 150 of a leading edge neighboring vane slot (e.g., 114*a* as shown in FIG. 6), to draw fluid from the straight portion 150 of the vane slot 114*a* into the lubrication pad 140. In certain embodiments, e.g., as shown in FIGS. 5-7, a number of lubrication pads 140 can be equal to a number of lands 118 of the rotor 102, wherein each land 118 includes one lubrication pad 140. In this case, the second port plate 112 may be a pressure loaded port plate 112 which can force the rotor 102 to contact the first stationary port 108, e.g., to interface the first end face 106. Here, the lubrication pads 140 may only be needed at the first end face 106 as it is a wear surface when pressure loaded against the first stationary port plate 108. In this case, there may not be any lubrication pads defined in the second end face 110.

In certain embodiments, e.g., as described with respect to FIG. 2 and shown in FIG. 7, the second port plate can be a second stationary port plate 212, creating a second wear surface, e.g., at the interface of the second end face 110 and the second stationary port plate 212. Here, the number of lubrication pads 140 can be double a number of lands 118 of the rotor 202, wherein each land includes two lubrication pads 140, one on the first end face 106 and one on a second end face 110. In such embodiments, each land 118 can additionally include a portion of the second end face 110 and a lubrication pad 240 can be defined in the second end face 110 of at least one land 118 between neighboring vane slots 114 such that the neighboring vane 114 slots feed the fluid to both lubrication pads 140, 240 to create a lubrication film between the second end face 110 and a second stationary port plate 212. The second end face 110 can be the same or similar to the first end face 106, in embodiments, for example, the lubrication pads 240 can be the same or similar to the lubrication pads 140. In certain embodiments, the polygonal shape of the lubrication pads 240 defined in the second end face 110 can be different than the polygonal shape of the lubrication pads 140 defined in the first end face 106.

In embodiments, the vane pump rotor can be pressure loaded (e.g., via a pressure loaded port plate), which pushes the rotor to one side to rub against the first stationary port plate, or the rotor may include two stationary port plates bookending the rotor end faces. The interface between the stationary port plate and the respective rotor end face is a wear surface, and thus the material of the rotor and port plate must be able to withstand the wear. Embodiments include a lubrication pad in each land at the respective wear surfaces between the rotor end face and port plate which allows a fluid film to build between the rotor and port plate so that the rotor end faces do not actually contact the port plates. This can extend the life of the rotor and end face as well as allow for different materials to be used, for example lighter materials, but that may be less fracture resistant.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the apparatus and methods of the subject disclosure have been shown and described, those skilled in the art will readily appreciate that changes and/or modifications may be made thereto without departing from the scope of the subject disclosure.

What is claimed is:

1. A system, comprising:

a rotor configured to rotate about a rotor axis within a pump housing, the rotor comprising:

a first end face configured to interface with a stationary port plate;

a plurality of vane slots defined in the rotor and arranged circumferentially about the rotor axis, wherein each vane slot of the plurality of vane slots is configured to accept a respective vane therein, wherein each vane slot includes a straight portion and a round portion radially inward of the straight portion, wherein the round portion is configured to hold a fluid during rotation of the rotor;

a plurality of lands, wherein each land of the plurality of lands extends circumferentially relative to the rotor axis from a leading edge to a trailing edge between two vane slots of the plurality of vane slots, wherein each land includes a portion of the first end face;

a lubrication pad defined in an outer periphery of the first end face, and extending from the first end face into a land of the plurality of lands, wherein the lubrication pad extends from the leading edge to the trailing edge such that the lubrication pad is fed by the two vane slots to induce buildup of a lubrication film between the first end face and the stationary port plate in the lubrication pad;

wherein a leading edge depth of the lubrication pad is deeper at or near the leading edge of the land and shallows in a circumferential direction of flow over the lubrication pad to a trailing edge depth, wherein the trailing edge depth is shallower at or near the trailing edge of the land than at the leading edge of the land, and wherein the leading edge depth of the lubrication pad is fluidically connected to the straight portion of a first vane slot of the two vane slots to draw fluid from the straight portion of the first vane slot.

2. The system of claim 1, wherein the lubrication pad includes a polygonal shape defined between a leading edge and a trailing edge of the at least one land relative to a direction of rotation of the rotor, wherein a length of the polygonal shape extends along a portion of the first end face between leading edge and the trailing edge.

3. The system of claim 1, wherein the lubrication pad includes a polygonal shape defined between a leading edge and a trailing edge of the at least one land relative to a direction of rotation of the rotor, wherein a length of the polygonal shape extends along an entirety of the first end face between leading edge and the trailing edge.

4. The system of claim 1, wherein a number of lubrication pads is equal to a number of lands of the rotor, wherein each land includes one lubrication pad.

5. The system of claim 4, wherein the rotor includes a second end face, opposite the first end face along the rotor axis, wherein each land includes a portion of the second end face, the rotor further comprising, a lubrication pad defined in the second end face of at least one land between neighboring vane slots such that the neighboring vane slots feed a fluid to the lubrication pad to create a lubrication film between the second end face and a second stationary port plate.

6. The system of claim 5, wherein the lubrication pad is defined in an outer periphery of the second end face.

7. The system of claim 5, wherein the lubrication pad includes a polygonal shape defined between a leading edge and a trailing edge of the at least one land relative to a direction of rotation of the rotor, wherein a length of the polygonal shape extends along a portion the second end face between leading edge and the trailing edge.

8. The system of claim 5, wherein the lubrication pad includes a polygonal shape defined between a leading edge and a trailing edge of the at least one land relative to a direction of rotation of the rotor, wherein a length of the polygonal shape extends along and entirety of the second end face between leading edge and the trailing edge.

9. The system of claim 5, wherein a leading edge depth of the lubrication pad is deeper at or near the leading edge of the land and shallows in a circumferential direction of flow over the lubrication pad to a trailing edge depth, wherein the trailing edge depth is shallower at or near the trailing edge of the land than at the leading edge of the land.

10. The system of claim 5, wherein a number of lubrication pads is double a number of lands of the rotor, wherein each land includes two lubrication pads, one on the first end face and one on the second end face.

11. The system of claim 1, further comprising a plurality of vanes, wherein each vane is disposed in a respective vane slot configured to drive the fluid with rotation of the rotor in the pump housing.

12. The system of claim 11, wherein the rotor includes a central bore defined therethrough, and further comprising, a shaft disposed in the central bore configured to drive rotation of the rotor about the rotor axis.

13. The system of claim 12, further comprising the stationary port plate disposed on the shaft proximate the first end face, and the second stationary port plate disposed on the shaft proximate the second end face opposite the first end face.

14. A rotor for a vane pump extends axially along a rotor axis, and wherein the rotor comprises:

a first end face at a first end of the rotor;

a first vane slot extending axially into the rotor from the first end face;

a first straight portion extending axially into the rotor; and a first round portion extending axially into the rotor and radially inward of the first straight portion;

a second vane slot extending axially in the rotor from the first end face and spaced circumferentially from the first vane slot relative to the rotor axis, wherein the second vane slot comprises:

a second straight portion extending axially into the rotor; and a second round portion extending axially into the rotor and radially inward of the second straight portion;

a land circumferentially between the first vane slot and the second vane slot and forming a portion of the first end face, wherein the land comprises:

a leading edge at the first vane slot; and a trailing edge at the second vane slot;

a lubrication pad formed on the land at the first end of the rotor, wherein the lubrication pad extends axially relative to the rotor axis into the land from the first end face, and extends circumferentially relative to the rotor axis from the leading edge to the trailing edge such that the lubrication pad is fluidically connected to the first straight portion and the second straight portion, and wherein the lubrication pad is radially deeper at the leading edge than the trailing edge relative to the rotor axis.

* * * * *